US006028557A

United States Patent [19]

Oka

[11] Patent Number: 6,028,557

[45] Date of Patent: Feb. 22, 2000

[54] WINDOW GLASS ANTENNA SYSTEM

[75] Inventor: Hidetoshi Oka, Osaka, Japan

[73] Assignee: Nippon Sheet Glass Co., Ltd., Japan

[21] Appl. No.: 09/041,551

[22] Filed: Mar. 12, 1998

[30] Foreign Application Priority Data

Mar. 18, 1997 [JP] Japan ..... 9-065207

[51] Int. Cl.[7] ..... H01Q 1/32

[52] U.S. Cl. ..... 343/713; 343/704

[58] Field of Search ..... 343/713, 704; H01Q 1/32

[56] References Cited

U.S. PATENT DOCUMENTS

| | | | |
|---|---|---|---|
| 5,499,034 | 3/1996 | Fujii et al. | 343/713 |
| 5,521,606 | 5/1996 | Iijima et al. | 343/713 |
| 5,657,029 | 8/1997 | Iijima et al. | 343/713 |

FOREIGN PATENT DOCUMENTS

| | | | |
|---|---|---|---|
| 4-132401 | 5/1992 | Japan | H01Q 1/32 |
| 5-82113 | 11/1993 | Japan . | |
| 6237109 | 8/1994 | Japan . | |

*Primary Examiner*—Don Wong
*Assistant Examiner*—Hoang Nguyen
*Attorney, Agent, or Firm*—Adams & Wilks

[57] ABSTRACT

A window glass antenna system comprises a grounding electrode disposed on a surface of a side edge portion of a window glass and connected with a braided outer conductor of a coaxial cable, a feeding electrode disposed on the surface of the window glass side edge portion proximately to the grounding electrode and connected with a center conductor of the coaxial cable, a signal retrieval pattern extending downwardly from the feeding electrode along the window glass side edge portion and bent to provide a horizontal portion, and a radiation pattern connected substantially perpendicularly to an end portion of the horizontal portion of the signal retrieval pattern. As a result, the window glass antenna system can be easily disposed at the window glass side edge portion while exhibiting excellent performance.

25 Claims, 8 Drawing Sheets

RECEPTION SENSITIVITY CHARACTERISTICS OF WINDOW GLASS ANTENNAS

VOLTAGE STANDING WAVE RATIO (V.SWR) CHARACTERISTICS OF WINDOW GLASS ANTENNAS

RECEPTION SENSITIVITY CHARACTERISTICS OF WINDOW GLASS ANTENNAS

WINDOW GLASS ANTENNA SYSTEM

BACKGROUND OF THE INVENTION

1. Field of the Invention

This invention relates generally to a window glass antenna system and more particularly to an automobile telephone antenna system disposed on an automobile window glass for receiving and transmitting automobile telephone transmissions in the Ultra High Frequency (UHF) band.

2. Description of the Related Art

In Japanese Utility Model Laid-Open Publication No. HEI 5-82113, the assignee of this invention proposes a window glass antenna system as schematically illustrated in FIG. 7 hereof.

The proposed window glass antenna system 50 is designed for use with an automobile telephone of UHF band and comprises a radiation pattern 52 disposed on a surface of an automobile window glass 51 and having a vertical length of about ¼ wavelength, and a grounding pattern 53 having a vertical length of about ¼ wavelength and a horizontal length of about ¼–¾ wavelength, the grounding pattern 53 being formed of an outer frame pattern and a central pattern to thereby provide a centrally-opened configuration. A feeding point "A" is connected to a central portion of a coaxial cable 54 via a center conductor 54*a* while a ground point "B" is connected to a peripheral portion of the coaxial cable 54 via an outer conductor 54*b*. The center conductor and the outer conductor have limited lengths of 5 mm or less.

However, difficulty may be experienced in positioning the prior window glass antenna system 50 at the side edge of the window glass 51, because the grounding pattern 53 has an increased transverse dimension and the radiation pattern 52 is located centrally upwardly of the grounding pattern 53.

In Japanese Patent Laid-Open Publication No. HEI 6-237109, the assignee of the present invention also proposes another window glass antenna system as schematically illustrated in FIG. 8 hereof.

This prior window glass antenna system 60 includes a grounding pattern 65 having a reduced transverse length so that it can be easily mounted to a side edge portion of a window glass 61. The antenna system 60 also includes a radiation pattern 63, a signal retrieval pattern 64 extending from a feeding point "A" disposed at the side edge portion proximate to a side edge of the window glass 61, toward the radiation pattern 63, and a shield pattern 66 extending from a ground point "B" provided at the side edge portion proximate to the side edge of the window glass 61, around the feeding point "A" and on both sides along the entire length of the signal retrieval pattern 64, and having a balance-to-unbalance transformer. The grounding pattern 65 is generally rectangular in shape and connected to an end of the shield pattern 66. The feeding point "A" is connected to a central portion of a coaxial cable 67 via a center conductor 67*a* while the ground point "B" is connected to a peripheral portion of the coaxial cable 67 via an outer conductor 67*b*. Designated by reference numeral 62 are defogging heaters connected at both ends by common feeding terminals or bus bars 62*b* and 62*c*.

In this window glass antenna system 60, however, because the grounding pattern 65 is reduced in a transverse length to thereby enable easy mounting of the antenna system to the side edge portion of the window glass, it becomes necessary to provide the shield pattern 66 for connecting the ground point "B" and the grounding pattern 65, which causes impedance mismatching to thereby decrease the antenna gain.

SUMMARY OF THE INVENTION

The present invention has been attained with a view to overcome the foregoing problems. It is therefore an object of the present invention is to provide an automobile window glass transmitter-receiver antenna system which does not require the provision of a grounding pattern and a shield pattern and which can be easily attached to a side edge portion of a window glass while exhibiting excellent performance.

According to the present invention, there is provided a window glass antenna system comprising a grounding electrode disposed on a surface of a side edge portion of a window glass and connected with a braided outer conductor of a coaxial cable, a feeding electrode disposed on the surface of the window glass side edge portion proximately to the grounding electrode and connected with a center conductor of the coaxial cable, a signal retrieval pattern extending downwardly from the feeding electrode along the window glass side edge portion and bent to provide a horizontal portion, and a radiation pattern connected substantially perpendicularly to an end portion of the horizontal portion of the signal retrieval pattern.

With this arrangement, it becomes possible to easily dispose the window glass antenna system at the window glass side edge portion, because a grounding pattern is no longer required in the antenna system.

Since a shield pattern is no longer required in the window glass antenna system, it also becomes possible to achieve good impedance matching to thereby improve the reception sensitivity of the antenna system.

Desirably, the antenna system according to the present invention further comprises an impedance adjusting element extending from the grounding electrode, and a separate impedance adjusting element extending from the end portion of the horizontal portion of the signal retrieval pattern.

With the two impedance adjusting elements being added to the window glass antenna system, it becomes possible to achieve further improved impedance matching.

In an altered form, the window glass antenna system includes a plurality of radiation patterns connected substantially perpendicularly to the end portion of the horizontal portion of the signal retrieval pattern.

Provision of the plural radiation patterns makes it possible to further increase the reception sensitivity of the antenna system and to keep the reception sensitivity difference within a used frequency band to a minimum.

BRIEF DESCRIPTION OF THE DRAWINGS

Preferred embodiments of the present invention will be described hereinbelow, by way of example only, with reference to the accompanying drawings, in which.

DETAILED DESCRIPTION OF THE PREFERRED EMBODIMENTS

The following description is merely exemplary in nature and is in no way intended to limit the invention or its application or uses.

Figure 1:
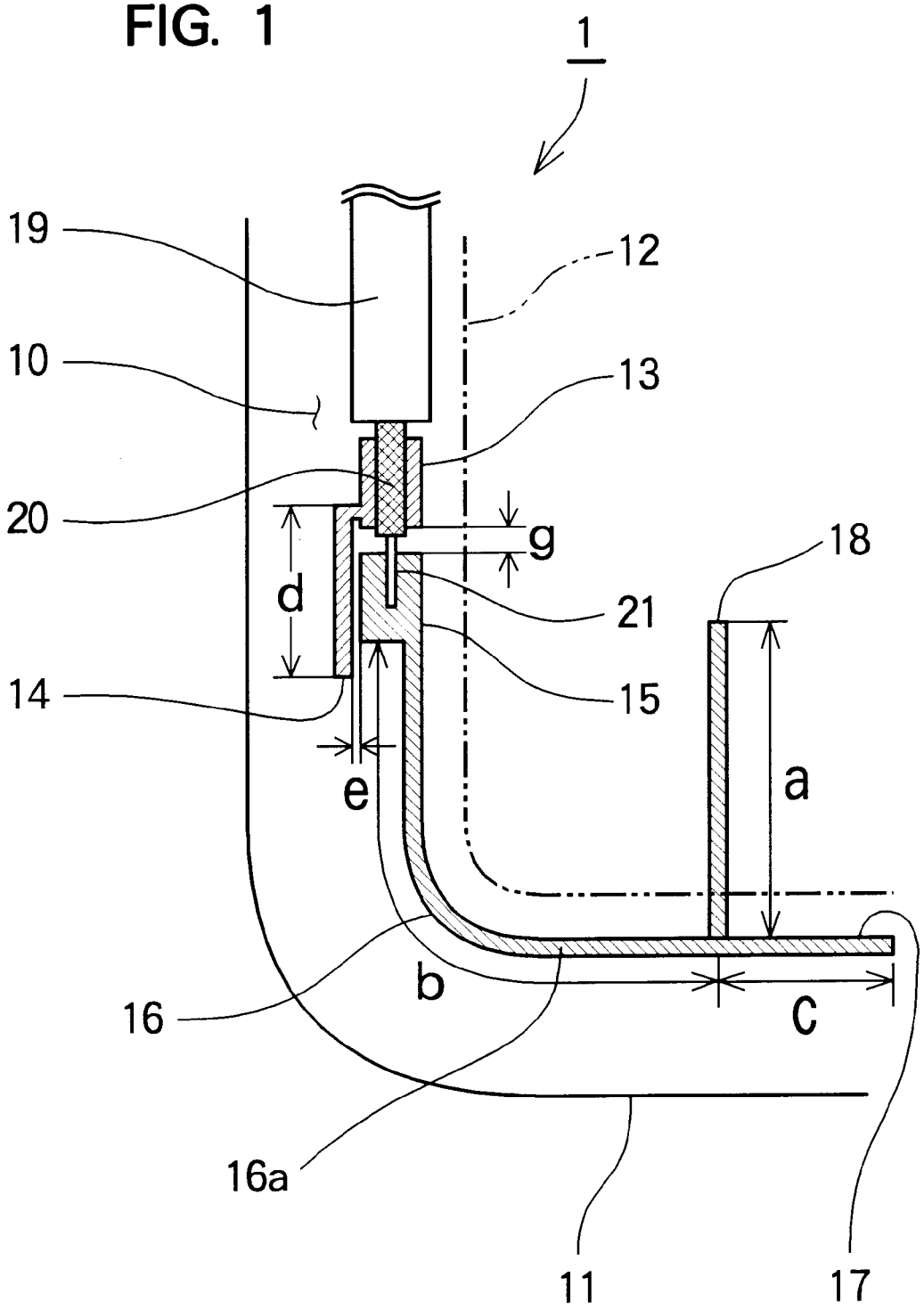
FIG. 1 is a schematic plan view illustrating an antenna pattern of a window glass antenna system according to the present invention.

Referring to FIG. 1, a window glass antenna system, generally designated by reference numeral 1, is disposed at a lower left corner of a window glass 10. The window glass antenna system 1 comprises a grounding electrode 13, a feeding electrode 15, a radiation pattern 18, impedance adjusting elements 14, 17, and a signal retrieval pattern 16.

Lengths of various patterns and elements used in the antenna are determined based on the wavelength of the antenna. The wavelength can be calculated using the formula:

$$\text{wavelength } \lambda=(3\times10^{11}/f)\times\gamma[\text{mm}]$$

where $3\times10^{11}$=speed of light, frequency f=850 MHz, and K factor $\gamma$=0.6. As the physical lengths of the patterns and elements are less than the calculated lengths, a factor K is included in the formula. This factor will vary depending on the diameter or width of the patterns and elements.

Grounding electrode 13 comprises a rectangular electrode pattern having a width of about 12 mm and a length of about 17 mm, which is disposed at a window glass side edge portion delimited by a masking line 12. The grounding electrode 13 is solder connected to an earth side braided outer conductor 20 at one end of a coaxial cable 19 which in turn is connected at an opposite end to an automobile telephone (not shown).

Feeding electrode 15 comprises a rectangular electrode pattern having a width of about 12 mm and a length of about 15 mm, which is disposed at the window glass side edge portion immediately below the grounding electrode 13 and spaced from the latter by about 5 mm as at "g". The feeding electrode 15 is solder connected to a center core or conductor 21 at the one end of the coaxial cable 19 opposite from the automobile telephone.

Signal retrieval pattern 16 is disposed at the window glass side edge portion substantially parallel to an edge 11 of the window glass 10 and has a length "b" ($\frac{5}{10}\lambda$–$\frac{8}{10}\lambda$) and a width of about 2 mm–5 mm. The signal retrieval pattern 16 extends downwardly from a lower right portion of the feeding electrode 15 along the glass edge 11 and is bent at a curved corner of the window glass 10 to thereby provide a horizontal portion 16*a*. The horizontal portion 16*a* of the signal retrieval pattern 16 terminates in a connection end where the radiation pattern 18 is connected.

Impedance adjusting element 17 designed for adjusting impedance continues from the connection end of the horizontal portion 16*a* and extends horizontally along the glass edge 11. The impedance adjusting element 17 has a width of about 2 mm–5 mm and a length "c" ($\frac{1}{10}\lambda$–$\frac{2}{10}\lambda$).

Impedance adjusting element 14 designed for adjusting impedance has a width of about 2 mm–5 mm and extends laterally from a lower left portion of the grounding electrode 13 for a short distance and then downwardly along the feeding electrode 15 with a space "e" (about 1 mm–4 mm) left between the element 14 and the electrode 15 for a distance "d" (about $\frac{1}{10}\lambda$–$\frac{2}{10}\lambda$).

Radiation pattern 18 has a lower end connected to the connection end of the horizontal portion 16*a* of the signal retrieval pattern 16 and extends substantially vertically therefrom. The radiation pattern has a width of about 2 mm–5 mm and a length "a" (about $\frac{2}{10}\lambda$–$\frac{4}{10}\lambda$).

Although it is disposed only at the lower left corner of the window glass 10 in FIG. 1, the window glass antenna system 1 may be disposed at two of four corners of the window glass 10 to thereby achieve diversity reception.

The above described patterns may be formed on the window glass 10 by screen printing an electrically conductive pasty mixture of an organic solvent with fine silver particles, glass powders of low melting point or the like, followed by baking. The patterns may take the form of an electrically conductive metallic line or foil.

Where the window glass is a laminated sheet glass, the patterns may be disposed on mating surfaces, an inner surface or an external surface of the window glass. When the window glass is a single sheet glass, the patterns may be disposed on an inner or outer surface of the glass.

Table 1 below is a listing of values indicative of the reception sensitivity characteristics (1) of the inventive window glass antenna system as compared to those (60) of a conventional antenna system. These values were obtained by measuring with a reference dipole antenna set at 0 dB.

TABLE 1

RECEPTION SENSITIVITY CHARACTERISTICS OF WINDOW GLASS ANTENNA SYSTEMS

| frequencies (MHz) | present window glass antenna system (1) | conv. window glass antenna system (60) |
|---|---|---|
| 810 | −4.4 | −6.7 |
| 820 | −4.0 | −5.8 |
| 830 | −3.4 | −4.5 |
| 840 | −2.7 | −3.8 |
| 850 | −3.1 | −3.8 |
| 860 | −2.8 | −3.6 |
| 870 | −2.8 | −3.9 |
| 880 | −2.8 | −3.6 |
| 890 | −2.9 | −3.5 |
| 900 | −2.3 | −3.4 |
| 910 | −2.6 | −3.9 |
| 920 | −2.7 | −4.0 |
| 930 | −2.7 | −3.9 |
| 940 | −2.7 | −5.2 |
| 950 | −4.0 | −6.4 |
| 960 | −4.8 | −9.2 |
| averages | −3.2 | −4.7 |

0 dB: reference dipole antenna

For measuring the reception sensitivity characteristics (1) shown in Table 1, the window glass antenna system 1 was disposed at a lower left corner of the window glass 10. In addition, it was provided with an impedance adjusting element 14, a signal retrieval pattern 16, an impedance adjusting element 17 and a radiation pattern 18, each having a width of 4 mm, with "a" of the radiation pattern 18 being set to be 70 mm, "e" and "d" of the impedance adjusting element 14 being set to be respectively 2 mm and 40 mm, "c" of the impedance adjusting element 17 being set to be 40 mm, and with "b" of the signal retrieval pattern 16 being set to be 140 mm. It was also provided with a grounding electrode 13 and a feeding electrode 15, each having a width of 12 mm and a length of 17 mm, which are connected to a 2.5D–2V coaxial cable 19 (characteristic impedance 50Ω) of 1.5 m long.

Figure 8:
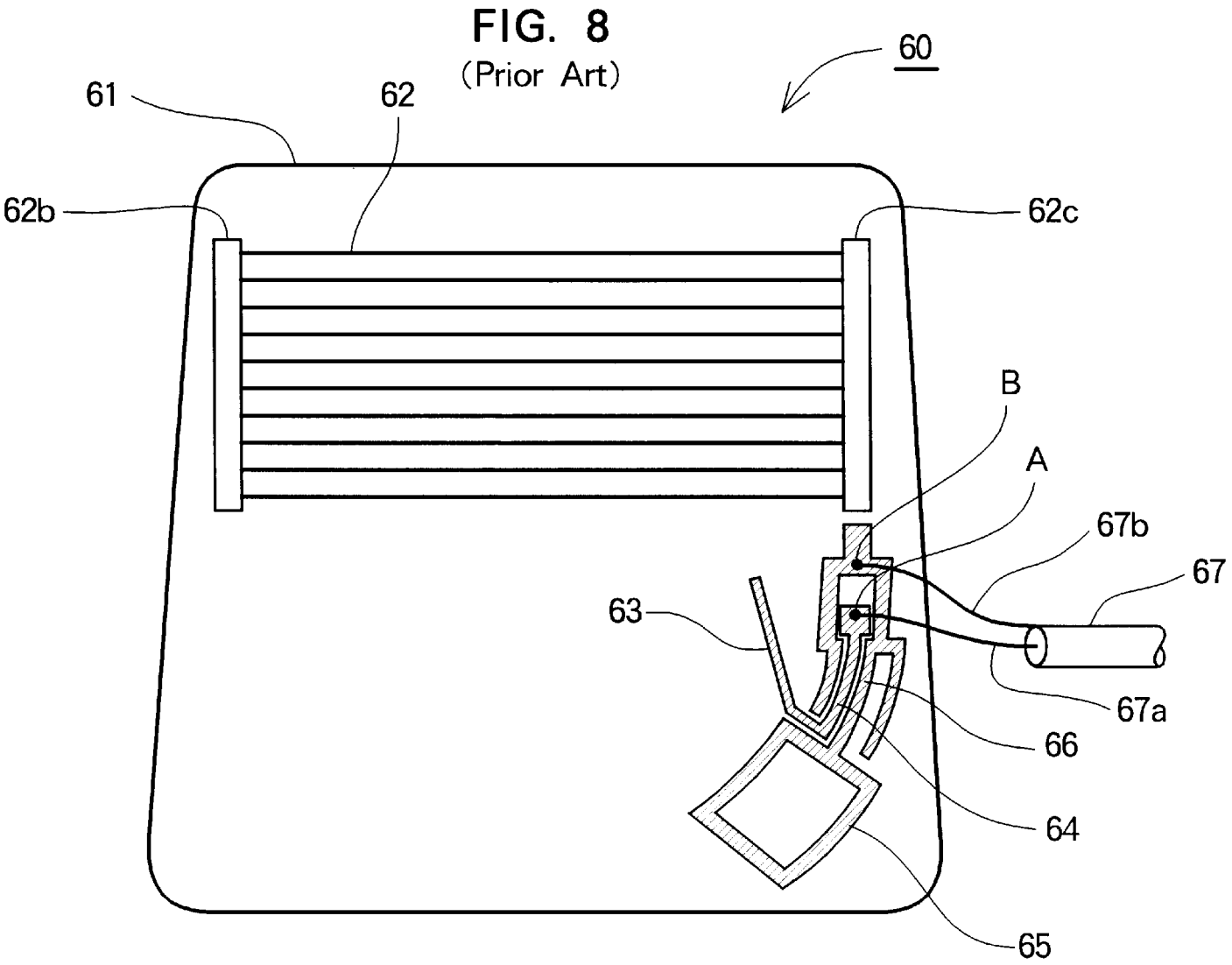
FIG. 8 (Prior Art)
FIG. 8 a schematic plan view illustrating a separate conventional window glass antenna system.

For comparison, the reception sensitivity characteristics (60) was obtained using the conventional window glass antenna system 60 shown in FIG. 8 hereof, that is, the one disclosed in Japanese Patent Laid-Open Publication No. 6-237109.

Figure 2:
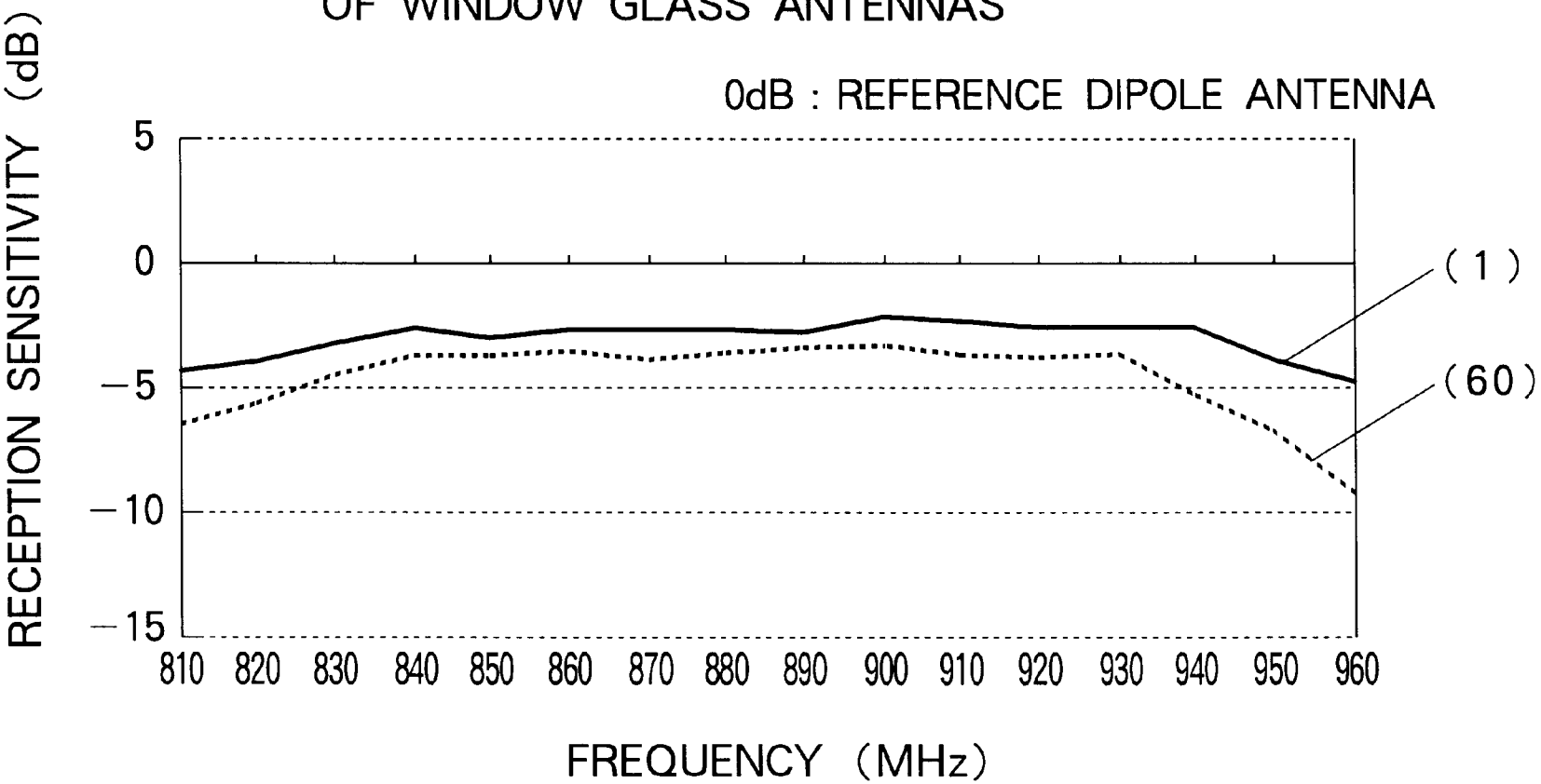
FIG. 2 is a graph showing the reception sensitivity characteristics of the window glass antenna system.

Turning now to FIG. 2, the reception sensitivity characteristics (1) and (60) of the inventive and conventional window glass antenna systems 1 and 60 are graphically represented with the frequencies shown along a transverse axis and the reception sensitivity shown along a vertical axis.

As can be readily appreciated from Table 1 and FIG. 2, the window glass antenna system 1 exhibits the reception sensitivity higher by about 1.5 dB on average than the conventional window glass antenna system 60. It will also be appreciated that the window glass antenna system 1 achieves the reception sensitivity of more than −4.8 dB over the entire bandwidth of 810 MHz–960 MHz while keeping the reception sensitivity deviation to less than 3.0 dB and thus provides good characteristics.

Figure 3:
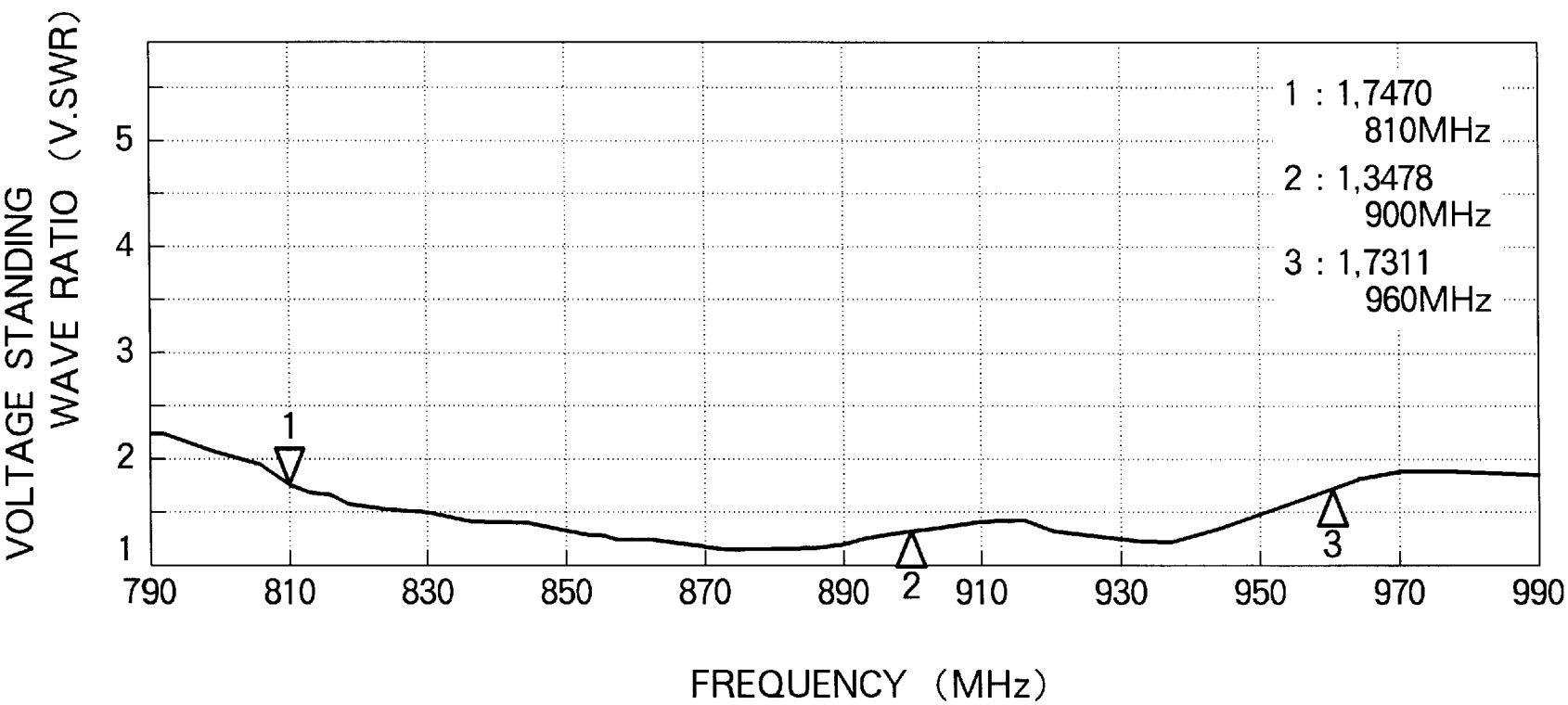
FIG. 3 is a graph showing the voltage standing wave ratio (VSWR) characteristics of the window glass antenna system.

In FIG. 3, there are shown voltage standing wave ratio (V.SWR) characteristics of the window glass antenna system 1.

For obtaining these characteristics, the window glass antenna was disposed at a lower left corner of the window glass 10 and provided with an impedance adjusting element 14, a signal retrieval pattern 16, an impedance adjusting element 17 and a radiation pattern 18, each having a width of 4 mm, with "a" of the radiation pattern 18 being set to be 70 mm, "e" and "d" of the impedance adjusting element 14 being set to be respectively 2 mm and 40 mm, "c" of the impedance adjusting element 17 being set to be 40 mm and "b" of the signal retrieval pattern 16 being set to be 140 mm. The antenna system 1 was also provided with a grounding electrode 13 and a feeding electrode 15, both being 12 mm wide and 17 mm long, which are connected to a 2.5D–2V coaxial cable 19 (characteristic impedance 50Ω) of 1.5 m long.

As can be appreciated from the V.SWR graph of FIG. 3 indicative of the antenna performance, the window glass antenna system 1 has a voltage standing wave ratio of less than 1.75 over the frequency bandwidth of 810 MHz–960 MHz and thus produces characteristics sufficient for practical purposes.

Figure 4:
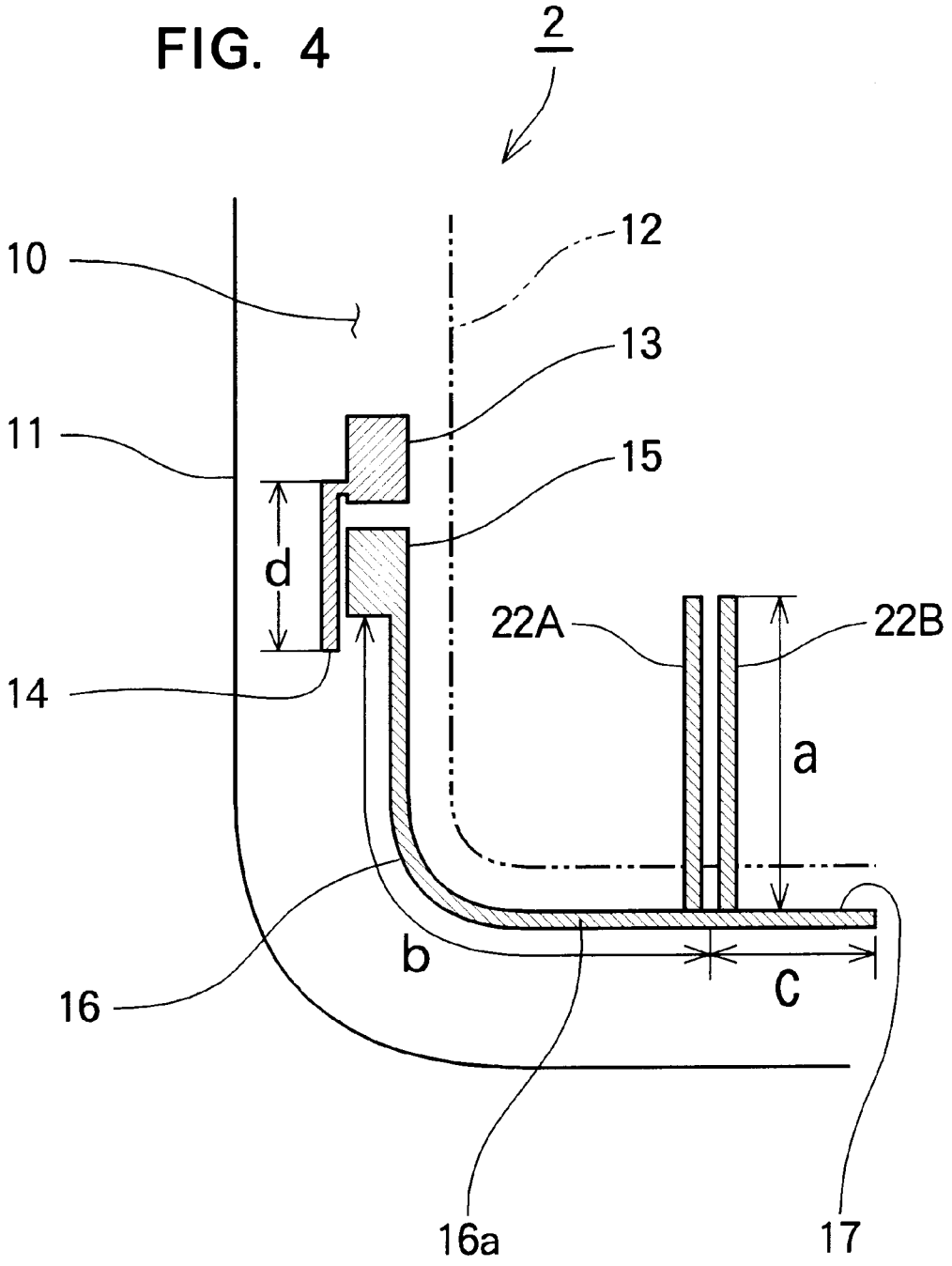
FIG. 4 is a schematic plan view illustrating a first alteration of the antenna pattern of the window glass antenna system.
Figure 5:
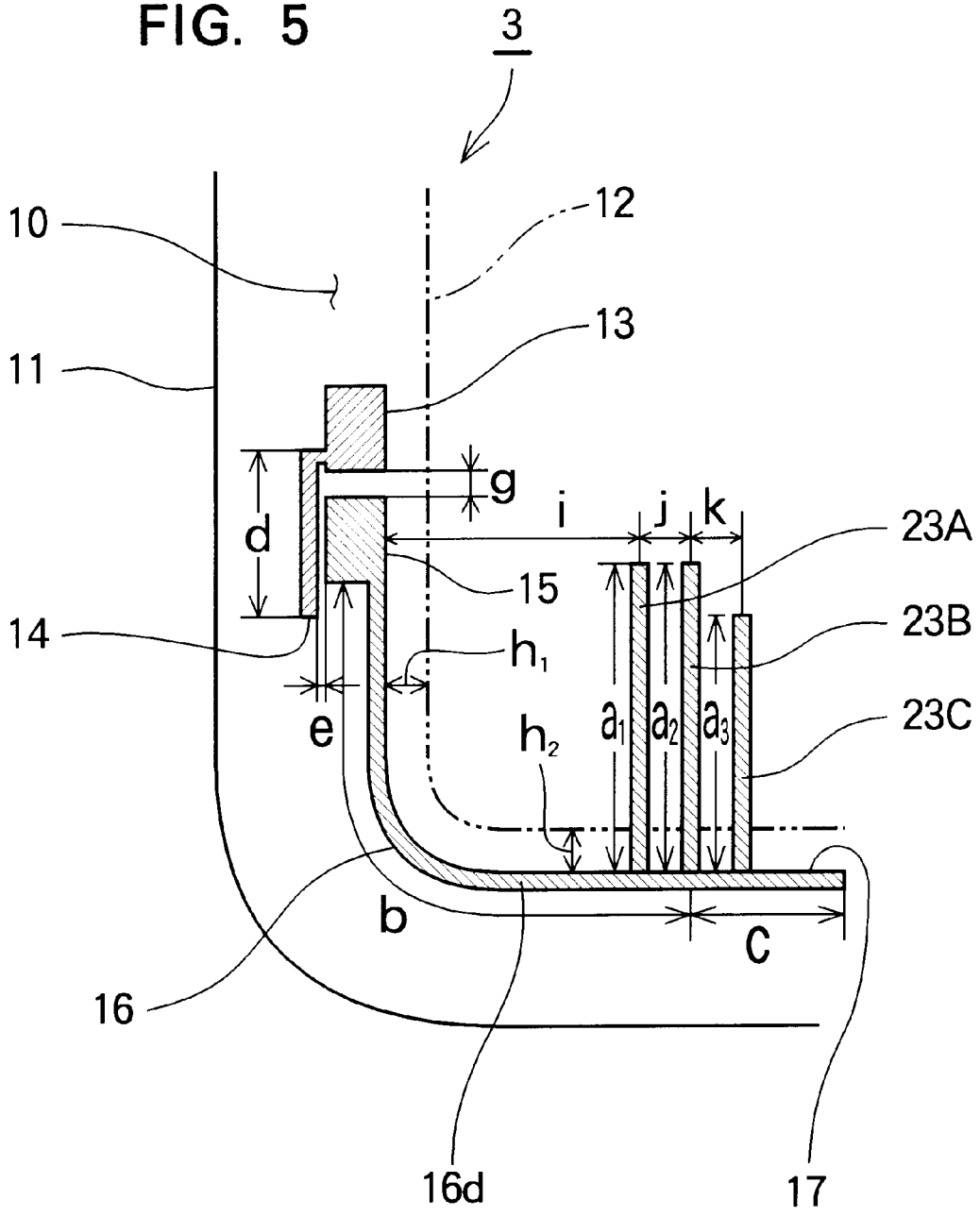
FIG. 5 is a schematic plan view illustrating a second alteration of the antenna pattern of the window glass antenna system.

Reference is now made to FIG. 4 and 5 illustrating respectively a first and a second alteration of the window glass antenna system 1 according to the present invention. In these figures, like reference numerals are used for corresponding parts of the window glass antenna 1 shown in FIG. 1 and their description will be omitted.

As shown in FIG. 4, a window glass antenna system 2 according to the first alteration is disposed at a lower left corner of an automobile window glass 10 and comprised of a grounding electrode 13, a feeding electrode 15, two radiation patterns 22A, 22B, impedance adjusting element 14, 17, and a signal retrieval pattern 16.

Referring to FIG. 5, there is shown a window glass antenna system 3 according to the second alteration, which is disposed on a lower left corner of an automobile window glass 10. It comprises a grounding electrode 13, a feeding electrode 15, three radiation patterns 23A, 23B, 23C, impedance adjusting elements 14, 17, and a signal retrieval pattern 16. First two of the radiation patterns 23A, 23B have lengths a1, a2 while the third one 23C has a width slightly shorter than the lengths a1, a2.

Figure 6:
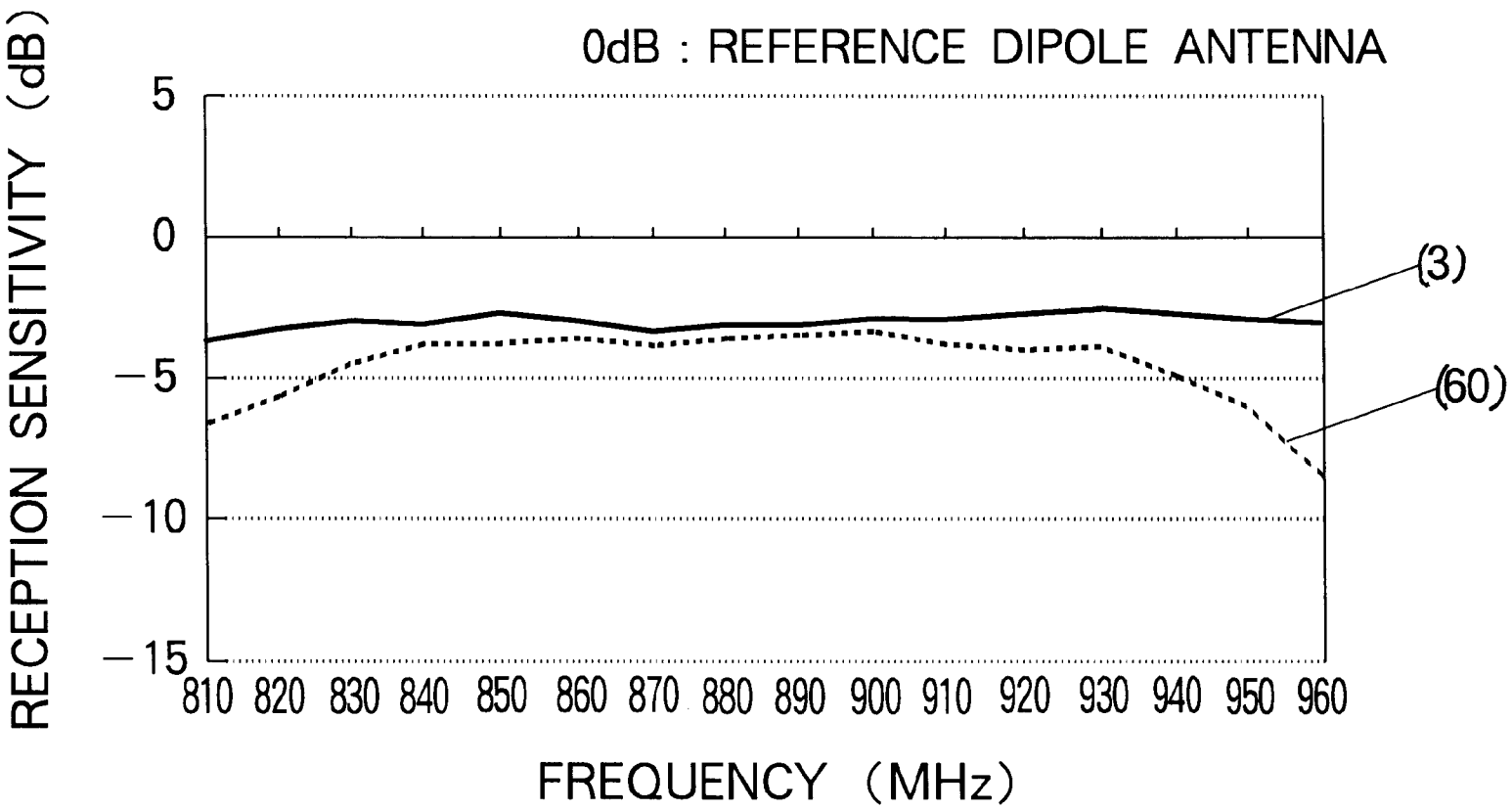
FIG. 6 is a graph showing the reception sensitivity characteristics of the window glass antenna system employing the second alteration of the antenna pattern, as compared to those of a conventional window glass antenna system.
Figure 7:
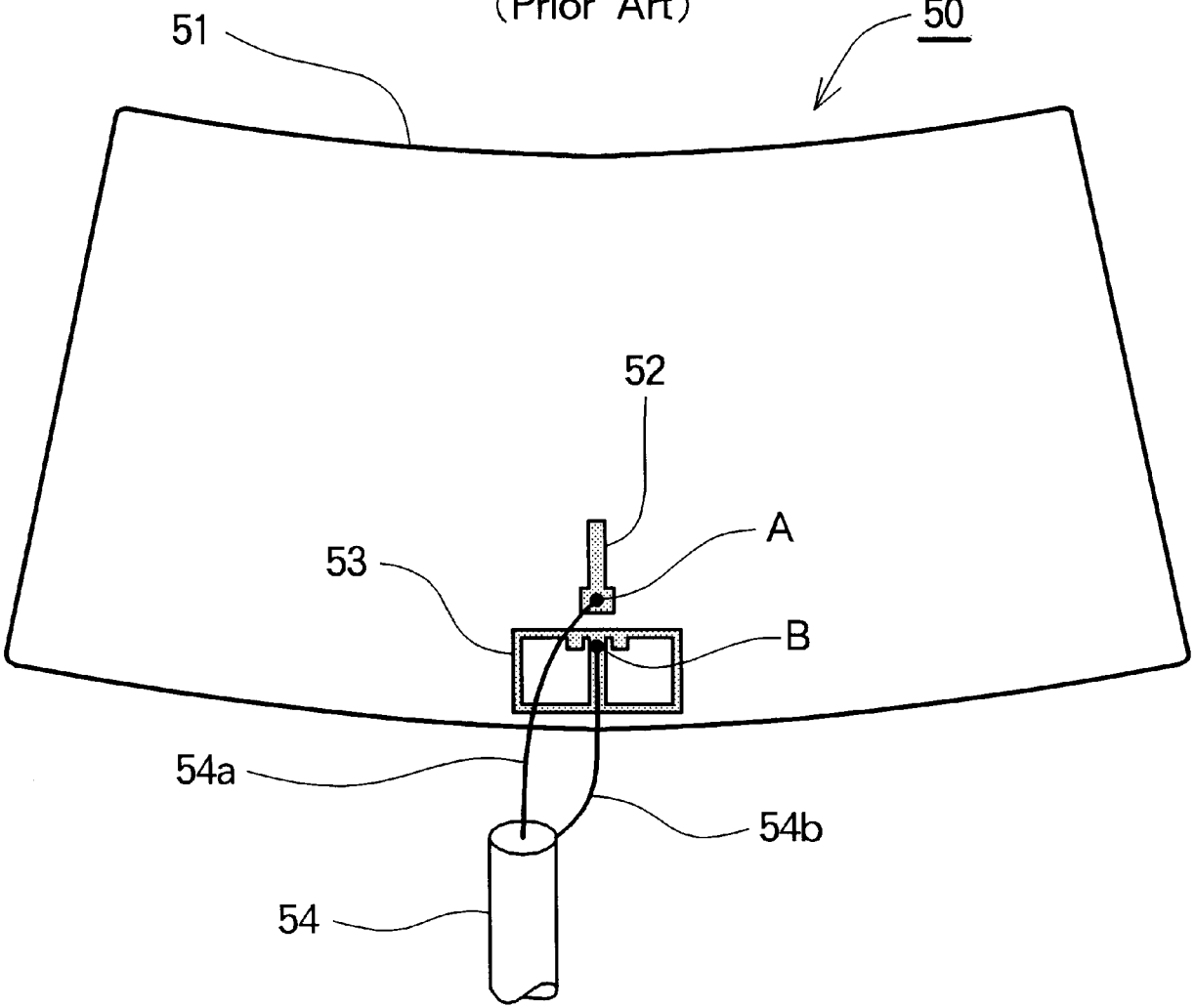
FIG. 7 (Prior Art)
FIG. 7 is a schematic plan view illustrating a conventional window glass antenna system.

Table 2 below and FIG. 6 illustrate the reception sensitivity characteristics of the window glass antenna system 3 of FIG. 5. These characteristics have been obtained by measuring with the antenna system 3 disposed on a lower left corner of the window glass 10 and having a grounding electrode 13 and a feeding electrode 15, both being 12 mm wide and 17 mm long, which are connected to a 2.5D–2V coaxial cable 19 (characteristic impedance 50Ω) of 1.5 m long.

Specific dimensions of the measured antenna system 3 are as follows:

width of the impedance adjusting element 14: 3 mm; width of the signal retrieval pattern 16, impedance adjusting element 17 and radiation patterns 23A, 23B, 23C: 4 mm;

| | | | |
|---|---|---|---|
| $a_1$: 70 mm; | $a_2$: 70 mm; | $a_3$: 65 mm; | e: 2 mm; |
| d: 40 mm; | c: 28 mm; | b: 140 mm; | $h_1$: 10 mm; |
| $h_2$: 10 mm; | i: 45 mm; | j: 10 mm; | $k_1$: 10 mm |

TABLE 2

RECEPTION SENSITIVITY CHARACTERISTICS OF WINDOW GLASS ANTENNA SYSTEMS

| frequencies (MHz) | conv. window glass antenna system (60) | present window glass antenna system (3) |
|---|---|---|
| 810 | −6.7 | −3.6 |
| 820 | −5.8 | −3.2 |
| 830 | −4.5 | −2.9 |
| 840 | −3.8 | −3.1 |
| 850 | −3.8 | −2.6 |
| 860 | −3.6 | −2.9 |
| 870 | −3.9 | −3.3 |
| 880 | −3.6 | −3.1 |
| 890 | −3.5 | −3.2 |
| 900 | −3.4 | −2.9 |
| 910 | −3.9 | −2.9 |
| 920 | −4.0 | −2.8 |
| 930 | −3.9 | −2.6 |
| 940 | −5.2 | −2.9 |
| 950 | −6.4 | −3.1 |
| 960 | −9.2 | −3.0 |
| averages | −4.7 | −3.0 |

0 dB: reference dipole antenna

Table 2 is a listing of values indicative of the reception sensitivity characteristics (3) of the window glass antenna system 3 as compared to those (60) of the conventional window glass antenna system 60 disclosed in Japanese Patent Laid-Open Publication No. 6-237109.

FIG. 6 is a graphical representation of the reception sensitivity characteristics (3) and (60) of the window glass antenna system 3 and conventional antenna system 60, wherein the frequencies are shown along a transverse axis and the reception sensitivity is shown along a vertical axis.

As can be readily appreciated from Table 2 and FIG. 6, the window glass antenna system 3 exhibits the reception sensitivity higher by about 1.7 dB on average than the conventional window glass antenna system 60. It will also be appreciated that the window glass antenna system 3 achieves a reception sensitivity of more than −3.6 dB over the entire bandwidth of 810 MHz–960 MHz while keeping the reception sensitivity deviation to less than 1.0 dB and thus provides good characteristics.

With the window glass antenna system 3 arranged as explained above, it becomes possible to provide increased reception sensitivity and to keep a reception sensitivity deviation in a used frequency bandwidth to a minimum.

Obviously, various minor changes and modifications are possible in the light of the above teaching. It is to be understood that within the scope of the appended claims the present invention may be practiced otherwise than as specifically described.

What is claimed is:

1. A window glass antenna system comprising:

a grounding electrode disposed on a first surface of a window glass proximate an edge thereof and connected with an outer conductor of a coaxial cable;

a feeding electrode disposed on the first surface of the window glass proximate the grounding electrode and being connected with a center conductor of the coaxial cable;

a signal retrieval pattern extending from the feeding electrode proximate the window glass side edge; and a radiation pattern extending from an end portion of the signal retrieval patterns;

wherein the grounding electrode is spaced by a small gap from the feeding electrode and does not extend substantially therefrom.

2. A window glass antenna system according to claim 1; wherein the grounding electrode is disposed proximate a corner of the window glass.

3. A window glass antenna system according to claim 1; wherein the signal retrieval pattern has a vertical portion extending downwardly from the feeding electrode and proximate a side edge of the window glass, a bent portion proximate a corner of the window glass and a horizontal portion extending substantially parallel and proximate to a lower edge of the window glass.

4. A window glass antenna system according to claim 3; further comprising a first impedance adjusting element extending from the grounding electrode, and a second impedance adjusting element extending from an end of the horizontal portion of the signal retrieval pattern.

5. A window glass antenna system according to claim 3; wherein the radiation pattern comprises a plurality of radiation patterns extending substantially vertically from an end portion of the horizontal portion of the signal retrieval pattern.

6. A window glass antenna system according to claim 1; wherein the grounding electrode, the feeding electrode, the signal retrieval pattern and the radiation pattern are mounted to one of an inner and outer surface of the window glass.

7. A window glass antenna system according to claim 1; wherein the window glass comprises a laminated structure and the grounding electrode, the feeding electrode, the signal retrieval pattern and the radiation pattern are mounted within the laminated structure.

8. A window glass antenna system according to claim 1; wherein the grounding electrode comprises a rectangularly-shaped electrode pattern.

9. A window glass antenna system according to claim 8; wherein the grounding electrode has a width of approximately 12 mm and a length of approximately 17 mm.

10. A window glass antenna system according to claim 1; wherein the grounding electrode is soldered to one end of the outer conductor of the coaxial cable and an opposite end of the coaxial cable is connected to a communication device.

11. A window glass antenna system according to claim 1; wherein the feeding electrode comprises a rectangular electrode pattern.

12. A window glass antenna system according to claim 11; wherein the feeding electrode has a width of approximately 12 mm and a length of approximately 15 mm.

13. A window glass antenna system according to claim 11; wherein the signal retrieval pattern has a length approximately within the range of about $\frac{5}{10}\lambda$–$\frac{8}{10}\lambda$ (wherein $\lambda$ is the wavelength of a received signal) and a width of approximately 2 mm–5 mm.

14. A window glass antenna system according to claim 1; wherein the grounding electrode is spaced from the feeding electrode by a gap of approximately 5 mm.

15. A window glass antenna system according to claim 1; wherein the signal retrieval pattern extends substantially parallel to an edge of the window glass.

16. A window glass antenna system according to claim 1; wherein the signal retrieval pattern extends downwardly from a lower right-hand portion of the feeding electrode proximate the window glass edge.

17. A window glass antenna system according to claim 16; wherein the signal retrieval pattern is bent at a curved corner of the window glass and has a horizontal portion extending substantially parallel with and proximate to a horizontal portion of the window glass.

18. A window glass antenna system according to claim 17; wherein the horizontal portion of the signal retrieval pattern terminates at a connection end where the radiation pattern is connected.

19. A window glass antenna system according to claim 18; further comprising a first impedance adjusting element abutting the connection end of the horizontal portion of the signal retrieval pattern and extends horizontally proximate the window glass edge.

20. A window glass antenna system according to claim 19; wherein the first impedance adjusting element has a width within the range of approximately 2 mm–5 mm and a length within the range of approximately $\frac{1}{10}\lambda$–$\frac{2}{10}\lambda$ (wherein $\lambda$ is the wavelength of a received signal).

21. A window glass antenna system according to claim 18; wherein the radiation pattern has a lower end connected to the connection end of the horizontal portion of the signal retrieval pattern and extends substantially vertically therefrom.

22. A window glass antenna system according to claim 18; wherein the radiation pattern has a width in the range of approximately 2 mm–5 mm and a length within the range of approximately $\frac{2}{10}\lambda$–$\frac{4}{10}\lambda$ (wherein $\lambda$ is the wavelength of a received signal).

23. A window glass antenna system according to claim 1; wherein the signal retrieval pattern includes a vertical portion extending downwardly from the feeding electrode and proximate a side edge of the window glass, a bent portion disposed proximate a corner of the window glass, and a horizontal portion extending proximate a horizontal edge of the window glass, and the radiation pattern extends vertically upward from the horizontal portion of the signal retrieval pattern.

24. A window glass antenna system comprising:

a grounding electrode disposed on a surface of a side edge portion of a window glass and connected with a braided outer conductor of a coaxial cable;

a feeding electrode disposed on said surface of said window glass side edge portion proximately to said grounding electrode and connected with a center conductor of said coaxial cable;

a signal retrieval pattern extending downwardly from said feeding electrode along said window glass side edge portion and bent to provide a horizontal portion; and a radiation pattern connected substantially perpendicularly to an end portion of said horizontal portion of said signal retrieval pattern;

a first impedance adjusting element extending from the grounding electrode; and a second impedance adjusting element extending from said end portion of said horizontal portion of said signal retrieval pattern.

25. A window glass antenna system comprising:

a grounding electrode disposed on a surface of a side edge portion of a window glass and connected with a braided outer conductor of a coaxial cable;

a feeding electrode disposed on said surface of said window glass side edge portion proximately to said grounding electrode and connected with a center conductor of said coaxial cable;

a signal retrieval pattern extending downwardly from said feeding electrode along side window glass side edge portion and bent to provide a horizontal portion; and a radiation pattern connected substantially perpendicularly to an end portion of said horizontal portion of said signal retrieval pattern;

wherein said radiation pattern comprises a plurality of radiation patterns connected substantially perpendicularly to said end portion of said horizontal portion of said signal retrieval pattern.

* * * * *